US006164069A

United States Patent [19]

Takahashi et al.

[11] Patent Number: 6,164,069

[45] Date of Patent: Dec. 26, 2000

[54] HYDRAULIC DRIVE SYSTEM FOR CONSTRUCTION MACHINE

[75] Inventors: Ei Takahashi, Tsuchiura; Genroku Sugiyama, Ibaraki-ken, both of Japan

[73] Assignee: Hitachi Construction Machinery Co., Ltd., Tokyo, Japan

[21] Appl. No.: 09/102,628

[22] Filed: Jun. 23, 1998

[30] Foreign Application Priority Data

Jun. 23, 1997 [JP] Japan ..... 9-166034

[51] Int. Cl.[7] ..... F16D 31/02

[52] U.S. Cl. ..... 60/421; 60/429

[58] Field of Search ..... 60/421, 429; 91/6, 91/536

[56] References Cited

U.S. PATENT DOCUMENTS

| | | | |
|---|---|---|---|
| 3,800,669 | 4/1974 | Distler | 60/421 |
| 4,142,445 | 3/1979 | Lohbauer | 91/6 |
| 4,531,366 | 7/1985 | Moriya et al. | 60/421 |
| 4,534,268 | 8/1985 | Yagyu et al. | 91/6 |
| 4,561,824 | 12/1985 | Okabe et al. | 91/6 |
| 4,875,337 | 10/1989 | Sugiyama et al. | 60/421 |
| 5,101,627 | 4/1992 | Fujii et al. | 60/429 |
| 5,692,377 | 12/1997 | Moriya et al. | 60/429 |

FOREIGN PATENT DOCUMENTS 2-15650 1/1990 Japan .

*Primary Examiner*—F. Daniel Lopez
*Attorney, Agent, or Firm*—Evenson, McKeown, Edwards & Lenahan, P.L.L.C.

[57] ABSTRACT

Arranged on a side of a first pump are a flow control valve for controlling a first boom cylinder, a flow control valve for an arm, said flow control valve being connected in tandem with said flow control valve and being adapted to control an arm cylinder, and a flow control valve for a second boom, said flow control valve being connected to a downstream side of the flow control valve and being adapted to control a second boom cylinder. On a side of a second pump, an additional flow control valve for the arm, said additional flow control valve being adapted to control the arm cylinder, an additional flow control valve for controlling the first boom cylinder, and a reserve flow control valve for controlling an attachment-driving actuator are connected in parallel with each other, and a shuttle valve is also arranged to output a pilot pressure, which is normally used to change over the flow control valve for the second boom, to the flow control valve for the arm, whereby the flow control valve for the arm is changed over to permit feeding hydraulic pressure from the first pump to the flow control valve for the second boom.

6 Claims, 7 Drawing Sheets

HYDRAULIC DRIVE SYSTEM FOR CONSTRUCTION MACHINE

BACKGROUND OF THE INVENTION

1. Field of the Invention

This invention relates to a hydraulic drive system for a construction machine which, like a hydraulic excavator having a first boom, a second boom and an arm, is provided with at least three elongated members and permits mounting of an attachment such as vibrator or gripper on a free end portion of the most distal elongated members.

2. Description of the Related Art

FIG. 7 is a hydraulic circuit diagram showing a conventional hydraulic drive system of the above-mentioned type for a construction machine.. The conventional art shown in FIG. 7 is applied, for example, to a hydraulic excavator. The conventional art will hereinafter be described with reference to FIG. 7.

The hydraulic excavator depicted in FIG. 7 is provided with elongated members, for example, three elongated members although they are not shown there. The first elongated member is a first boom connected to a pivot cab turnably in a vertical plane, the second elongated member is a second boom connected to the first boom turnably in the vertical plane, and the third elongated member is an arm connected to the second boom turnably in the vertical plane. To conduct usual work such as digging, a bucket is mounted on a free end of the arm. Upon conducting work such as breaking, demolition or the like of rocks or a building, an attachment such as a vibrator or gripper is mounted on the free end of the arm in place of the bucket.

As is illustrated in FIG. 7, the hydraulic excavator is provided, for example, with a first pump 13 having a displacement-varying mechanism 13*a*, a second pump 14 having a displacement-varying mechanism 14*a*, and a reservoir 22 with fluid stored therein for suction by these pumps 13,14.

The hydraulic excavator is also provided with a first hydraulic cylinder for turning the above-mentioned first elongated member, namely, a first boom cylinder 1 for turning an unillustrated first boom; a second hydraulic cylinder for turning the second elongated member, namely, a second boom cylinder for turning an unillustrated second boom; a third hydraulic cylinder for turning the third elongated member, namely, an arm cylinder 3 for turning an unillustrated arm; a bucket cylinder 4 for turning an unillustrated bucket; and an actuator 5 for turning the above-mentioned attachment (not shown).

A group of flow control valves connected to the first pump 13 includes, for example, a flow control valve 11 for the bucket, said flow control valve 11 having a center bypass passage and being capable of controlling a flow of pressure fluid delivered from the first pump 13 to feed it to the bucket cylinder 4; a primary flow control valve for the first elongated member, namely, a primary flow control valve 6 for the first boom, said flow control valve 6 being connected to the first pump 13 in parallel with the flow control valve 11 for the bucket, having a center bypass passage and being capable of controlling a flow of pressure fluid delivered from the first pump 13 to feed it to the first boom cylinder 1; and a primary flow control valve for the third elongated member, namely, a primary flow control valve 9 for the arm, said flow control valve 9 having a center bypass passage, being connected in tandem to a downstream side of the primary flow control valve 6 for the fist boom and being capable of controlling a flow of pressure fluid delivered from the first pump 13 to feed it to the arm cylinder 3.

A group of flow control valves connected to the second pump 14 includes, for example, an additional flow control valve for the third elongated member, namely, an additional flow control valve 10 for the arm, which can control a flow of pressure fluid delivered from the second pump 14 to feed it to the arm cylinder 3; an additional flow control valve for the first elongated member, namely, an additional flow control valve 7 for the first boom, which can control a flow of pressure fluid delivered from the second pump 14 to feed it to the first boom cylinder 1; and a reserve flow control valve 12 which can control a flow of pressure fluid delivered from the second pump 14 to selectively feed it to one of the above-mentioned second boom cylinder 2 and the above-mentioned attachment-driving actuator 5. The additional flow control valve 10 for the arm, the additional flow control valve 7 for the first boom and the reserve flow control valve 12 are connected to the second pump 14 in parallel with each other.

The primary flow control valve 9 for the arm and the additional flow control valve 10 for the arm are changed over by an arm operating device, for example, by a pilot valve 15 for the arm, which generates a pilot pressure. The reserve flow control valve 12 is changed over by a second boom/attachment operating device, for example, by a pilot valve 16*a* for the second boom and attachment, which generates a pilot pressure. The primary flow control valve 6 for the first boom and the additional flow control valve 7 for the first boom are changed over by a first boom operating device, for example, by a pilot valve 17 for the first boom, which generates a pilot pressure. The flow control valve 11 for the bucket is changed over by a bucket operating device, for example, by a pilot valve 19 for the bucket, which generates a pilot pressure.

The reserve flow control valve 12 is communicated to a directional control valve 52, to which the second boom cylinder 2 and the attachment-driving actuator 5 are connected. When the directional control valve 52 is maintained, for example, in a lower position as shown in FIG. 7, the reserve flow control valve 12 an the second boom cylinder 2 are in communication with each other while the reserve flow control valve 12 and the actuator 5 are cut off from each other. When the directional control valve 52 is changed over into an upper position, the reserve flow control valve 12 and the actuator 5 are brought into communication with each other while the reserve flow control valve 12 and the second boom cylinder 2 are cut off from each other. A control compartment of the directional control valve 52 is designed to be brought into selective communication with one of a hydraulic pressure source 51 and the reservoir 22 via a directional control valve 50.

With the conventional art constructed as described above, operations are performed as will be described next by way of example.

[single operation of the second boom]

When the directional control valve 50 is maintained in a right position as shown in FIG. 7, the control compartment of the directional control valve 52 is in communication with the reservoir 22 so that the directional control valve 52 is maintained in the lower position as shown in FIG. 7. Therefore, the reserve flow control valve 12 and the second boom cylinder 2 are in communication with each other via the directional control valve 52.

When the pilot valve 16*a* is operated in this state, the reserve flow control valve 12 is changed over, and pressure fluid is fed from the second pump 14 to the second boom cylinder 2 via the reserve flow control valve 12 and the directional control valve 52. The second boom cylinder 2 is hence operated, resulting in single operation of the unillustrated second boom.

[single operation of the attachment]

When the directional control valve 50 is changed over from the its position shown in FIG. 7 into a left position in FIG. 7, the control compartment of the directional control valve 52 and the hydraulic pressure source 51 are brought into communication with each other via the directional control valve 50, and the pressure fluid delivered from the hydraulic pressure source 51 is fed to the control compartment of the directional control valve 52. As a result, the directional control valve 52 is changed over into the upper position shown in FIG. 7, and the reserve flow control valve 12 and the actuator 5 are brought into communication with each other via the directional control valve 52.

When the pilot valve 16*a* is operated in this state, the reserve flow control valve 12 is changed over so that pressure fluid is fed from the second pump 14 to the actuator 5 via the reserve flow control valve 12 and the directional control valve 52. The actuator 5 is hence driven, resulting in single operation of the unillustrated attachment.

[Combined operation of the first boom, the second boom and the arm]

When the pilot valve 15 for the arm, the pilot valve 17 for the first boom and the pilot valve 16*a* are operated in the state that the directional control valves 50,52 are maintained in their respective positions shown in FIG. 7 and the reserve directional control valve 12 and the second boom cylinder 2 are in communication with each other as shown in FIG. 7, the primary flow control valve 9 for the arm, the additional flow control valve 10 for the arm, the primary flow control valve 6 for the first boom, the additional flow control valve 7 for the first boom and the reserve flow control valve 12 are changed over. As a result, for example, pressure fluid is fed from the first pump 13 to the first boom cylinder 1 primarily via the primary flow control valve 6 for the first boom so that the first boom cylinder 1 is actuated, and on the other hand, pressure oil is fed from the second pump 14 to the arm cylinder 3 primarily via the primary flow control valve 10 for the arm and also to second boom cylinder 2 primarily via the reserve flow control valve 12, whereby the arm cylinder 3 and the second boom cylinder 2 are actuated. By these actuations, combined operation of the unillustrated first boom, second boom and arm is performed.

[Combined operation of the first boom, the arm and the attachment]

When the pilot valve 15 for the arm, the pilot valve 17 for the first boom and the pilot valve 16*a* are operated in the state that the directional control valve 50 and the directional control valve 52 have been changed over to the left position and the upper position, respectively, from their respective positions shown in FIG. 7 and the reserve flow control valve 12 and the actuator 5 have been brought into communication with each other, the primary flow control valve 9 for the arm, the additional flow control valve 10 for the arm, the primary flow control valve 6 for the first boom, the primary flow control valve 7 for the first boom and the reserve flow control valve 12 are changed over to actuate or drive the first boom cylinder 1, the arm cylinder 3 and the actuator 5 in a similar manner as described above. Combined operation of the unillustrated first boom, arm and attachment is therefore performed.

The above-described conventional art permits combined operation of the first boom, the second boom and the arm or combined operation of the first boom, the arm and the attachment. It however cannot perform combined operation which includes operation of the second boom and the attachment. For example, it is impossible to operate the arm, the second boom an the attachment in combination.

In work, such as breaking or demolition, which is conducted by using an attachment, the operation-feasible range therefore tended to be limited. To change an operation-feasible range already set beforehand, complicated valve operation may be needed. For example, the directional control valve 50 is once changed over into the right position in FIG. 7 to change over the directional control valve 52 into the lower position shown in FIG. 7. As a consequence, the second boom cylinder 2 is caused to extend. Then, the directional control valve 50 is changed over into the left position in FIG. 7 to change over the directional control valve 52 into the upper position depicted in FIG. 7. The actuator 5 is hence driven to perform work by the attachment. Similarly, the directional control valve 50 is once changed over into the right position in FIG. 7 to change over the directional control valve 52 into the lower position shown in FIG. 7. As a consequence, the second boom cylinder 2 is caused to contract. Then, the directional control valve 50 is changed over into the left position in FIG. 7 to change over the directional control valve 52 into the upper position depicted in FIG. 7. The actuator 5 is hence driven to perform work by the attachment. This has led to the problem that no improvement can be expected in the efficiency of work by the attachment.

Further, due to the need for frequent change-over operation of the directional control valve 50, the operator tends to feel irksome and tired, resulting in the problem that the accuracy of work tends to drop.

Concerning the conventional art described above, the hydraulic excavator was referred to as a construction machine, and the problems associated with combined operation of the second boom and the attachment were described. In the case of a hydraulic drive system which is suited for use with a construction machine having three or more elongated members and an attachment and is of such construction as selectively driving the attachment and one of the elongated members, problems arise likewise from the combined operation of the attachment and the particular elongated member. A technique similar to the above-described conventional art is disclosed, for example, in JU kokai 2-15650.

SUMMARY OF THE INVENTION

With the foregoing circumstances of the conventional art in view, the present invention has as an object thereof the provision of a hydraulic drive system for a construction machine having at least three elongated members and an attachment, which can achieve combined operation of the attachment and any one or more of the three elongated members.

To achieve the above object, the present invention provides a hydraulic drive system for a construction machine, said hydraulic drive system being provided with a first pump and second pump of a variable displacement type, a first hydraulic cylinder for turning a first elongated member, a second hydraulic cylinder for turning a second elongated member connected to the first elongated member, a third hydraulic cylinder for turning a third elongated member connected to the second elongated member, and an actuator for driving an attachment connectable to the third elongated member, a primary first flow control valve having a center bypass passage and capable of controlling a flow of pressure fluid delivered from the first pump to feed the pressure fluid to the first hydraulic cylinder, a second flow control valve capable of controlling a flow of pressure fluid delivered from one of the first pump and second pump to feed the pressure fluid to the second hydraulic cylinder, and a primary third flow control valve having a center bypass passage, connected in tandem to a downstream side of the primary first flow control valve and capable of controlling a flow of pressure fluid delivered from the first pump to supply the pressure fluid to the third hydraulic cylinder, and an additional third flow control valve capable of controlling a flow of pressure fluid delivered from the second pump to feed the pressure fluid to the third hydraulic cylinder, an additional first flow control valve capable of controlling a flow of pressure fluid delivered from the second pump to feed the pressure fluid to the first hydraulic cylinder, and a reserve flow control valve capable of controlling a flow of pressure fluid delivered from the second pump to feed the pressure fluid to the actuator, the additional third flow control valve, the additional first flow control valve and the reserve flow control valve being connected to the second pump in parallel with each other, wherein the second flow control valve is arranged downstream of the primary third flow control valve; and a guide means (guide device) is arranged to guide pressure fluid, which is delivered from the first pump, to the second flow control valve upon changing over the second flow control valve.

According to the invention constructed as described above, when flow control valve for the second elongated member, the primary flow control valve for the third elongated member, the additional flow control member for the third elongated member and the reserve flow control valve are changed over, respectively, with the primary flow control valve for the first elongated member and the additional flow control valve for the first elongated member in half-operated positions, for example, the pressure fluid is guided from the first pump to the primary flow control valve for the first elongated member. Surplus fluid from the first pump as a result of half-operation of the primary flow control valve for the first elongated member is guided to the flow control valve for the second elongated member by the function of the guide means (guide device) as a result of the above-mentioned change-over of the flow control valve for the second elongated member. Accordingly, the pressure fluid is fed at a flow rate, which corresponds to a half stroke of the primary flow control valve for the first elongated member, to the hydraulic cylinder for the first elongated member via the primary flow control valve for the first elongated member, so that the first elongated member can be turned at a relatively slow speed. Further, the pressure fluid is also fed at a flow rate, which corresponds to a change-over stroke of the flow control valve for the second elongated member, to the hydraulic cylinder for the second elongated member via the flow control valve for the second elongated member, so that the second elongated member can be turned. On the other hand, the pressure fluid from the second pump is fed in parallel to the additional flow control valve for the first elongated member, the additional flow control valve for the third elongated member and the reserve flow control valve. Therefore, pressure fluid is fed to the hydraulic cylinder for the third elongated member primarily via the additional flow control valve for the third elongated member, so that the third elongated member can be turned. At the same time, pressure fluid is also fed to the actuator via the reserve flow control valve, so that the attachment can be driven. Depending on the relative levels of load pressures applied upon driving the respective elongated members and the attachment, surplus pressure fluid from the second pump merges with the above-mentioned pressure fluid flowed out of the primary flow control valve for the first elongated member via the additional flow control valve for the first elongated member, is fed to the hydraulic cylinder for the first elongated member, and is then used to turn the first elongated member. Further, a portion of surplus pressure fluid from the first pump merges with the above-mentioned pressure fluid flowed out of the additional flow control valve for the third elongated member, is fed to the hydraulic cylinder for the third elongated member, and is then used to turn the third elongated member.

Combined operation, which consists of turning of all the first, second and third elongated members and driving of the attachment, can be achieved as described above.

Stopping of the operation of the primary flow control valve for the first elongated member and the operation of the additional flow control valve for the first elongated member in the above-mentioned state makes it possible to achieve combined operation consisting of turning of the second elongated member by the pressure fluid from the first pump via the flow control valve for the second elongated member and the hydraulic cylinder for the second elongated member, turning of the third elongated member by the pressure fluid from the second pump via the primary flow control valve for the third elongated member and the hydraulic cylinder for the third elongated member and driving of the attachment by the pressure fluid from the second pump via the reserve flow control valve and the actuator, namely, combined operation consisting of turning of the second and third elongated members and driving of the attachment.

Similarly, stopping of the operation of the flow control valve for the second elongated member in the state of the above-described combined driving of the three elongated members and the attachment makes it possible to achieve combined operation consisting of turning of the first elongated member by the pressure fluid from the first pump via the primary flow control valve for the first elongated member and the hydraulic cylinder for the first elongated member, turning of the third elongated member by the pressure fluid from the second pump via the additional flow control valve for the third elongated member and the hydraulic cylinder for the third elongated member and driving of the attachment by the pressure fluid from the second pump via the reserve flow control valve and the actuator, namely, combined operation consisting of turning of the first and third elongated members and driving of the attachment.

Likewise, stopping of the operation of the primary flow control valve for the third elongated member and the operation of the additional flow control valve for the third elongated member and maintenance of the primary flow control valve for the first elongated member in the half-operated position in the state of the above-mentioned combined operation of the three elongated members and the attachment makes it possible to achieve combined operation consisting of turning of the first elongated member by the pressure fluid from the first pump via the primary flow control valve for the first elongated member and the hydraulic cylinder for the first elongated member, turning of the second elongated member by the pressure fluid from the first pump via the flow control valve for the second elongated member and the hydraulic cylinder for the second elongated member and driving of the attachment by the pressure fluid from the second pump via the reserve flow control valve and the actuator, namely, combined operation consisting of turning of the first and second elongated members and driving of the attachment.

Similarly, stopping of the operation of the flow control valve for the second elongated member, the operation of the primary flow control valve for the third elongated member and the operation of the additional flow control valve for the third elongated member in the state of the above-mentioned combined driving of the three elongated members and the attachment makes it possible to achieve combined operation consisting of driving of the first elongated member and the attachment.

In a similar manner, stopping of the operation of the primary flow control valve for the first elongated member and the additional flow control valve for the first elongated member and the operation of the primary flow control valve for the third elongated member and the additional flow control valve for the third elongated member in the state of the above-mentioned combined driving of the three elongated members and the attachment makes it possible to achieve combined operation consisting of driving of the second elongated member and the attachment.

Likewise, stopping of the operation of the primary flow control valve for the first elongated member, the operation of the additional flow control valve for the first elongated member and the flow control valve for the second elongated member in the state of the above-mentioned combined driving of the three elongated members and the attachment makes it possible to achieve combined operation consisting of driving of the three elongated members and the attachment.

As is understood from the foregoing, it is possible to achieve combined operation of the attachment and any one or more of the first, second and third elongated members.

To achieve the above-described object, the construction machine is a hydraulic excavator; the first elongated member is a first boom, the second elongated member is a second boom, the third elongated member is an arm, the hydraulic cylinder for the first elongated member is a first boom cylinder, the hydraulic cylinder for the second elongated member is a second boom cylinder, and the hydraulic cylinder for the third elongated member is an arm cylinder; the primary first flow control valve is a primary flow control valve for the first boom; the additional first flow control valve is an additional flow control valve for the first boom; the second flow control valve is a flow control valve for the second boom; the primary third flow control valve is a primary flow control valve for the arm; and the additional third flow control valve is an additional flow control valve for the arm.

According to the invention constructed as described above, when flow control valve for the second boom, the primary flow control valve for the arm, the additional flow control member for the arm and the reserve flow control valve are changed over, respectively, with the primary flow control valve for the first boom and the additional flow control valve for the first boom in half-operated positions, for example, the pressure fluid is guided from the first pump to the primary flow control valve for the first boom. Surplus fluid from the first pump as a result of half-operation of the primary flow control valve for the first boom is guided to the flow control valve for the second boom by the function of the guide means (guide device) as a result of the above-mentioned change-over of the flow control valve for the second boom. Accordingly, the pressure fluid is fed at a flow rate, which corresponds to the half stroke of the primary flow control valve for the first boom, to the first boom cylinder via the primary flow control valve for the first boom, so that the first boom can be turned at a relatively slow speed. Further, the pressure fluid is also fed at a flow rate, which corresponds to a changeover stroke of the flow control valve for the second boom, to the second boom cylinder via the flow control valve for the second boom, so that the second boom can be turned. On the other hand, the pressure fluid from the second pump is fed in parallel to the additional flow control valve for the first boom, the additional flow control valve for the arm and the reserve flow control valve. Therefore, pressure fluid is fed to the arm cylinder primarily via the additional flow control valve for the arm, so that the arm can be turned. At the same time, pressure fluid is also fed to the actuator via the reserve flow control valve, so that the attachment can be driven. Depending on the relative levels of load pressures applied upon driving the first and second booms, the arm and the attachment, surplus, pressure fluid from the second pump merges with the above-mentioned pressure fluid flowed out of the primary flow control valve for the first boom via the additional flow control valve for the first boom, is fed to the first boom cylinder, and is then used to turn the first boom. Further, a portion of surplus pressure fluid from the first pump merges with the above-mentioned pressure fluid flowed out of the additional flow control valve for the arm, is fed to the arm cylinder, and is then used to turn the arm.

Combined operation, which consists of turning of all the first and second booms and the arm and driving of the attachment, can be achieved as described above.

Stopping of the operation of the primary flow control valve for the first boom and the operation of the additional flow control valve for the first boom in the above-mentioned state makes it possible to achieve combined operation consisting of turning of the second boom by the pressure fluid from the first pump via the flow control valve for the second boom and the second boom cylinder, turning of the arm by the pressure fluid from the second pump via the additional flow control valve for the arm and the arm cylinder and driving of the attachment by the pressure fluid from the second pump via the reserve flow control valve and the actuator, namely, combined operation consisting of turning of the second boom and arm and driving of the attachment.

Similarly, stopping of the operation of the flow control valve for the second boom in the state of the above-described combined driving of the first and second booms, the arm and the attachment makes it possible to achieve combined operation consisting of turning of the first boom by the pressure fluid from the first pump via the primary flow control valve for the first boom and the first boom cylinder, turning of the arm by the pressure fluid from the second pump via the additional flow control valve for the arm and the arm cylinder and driving of the attachment by the pressure fluid from the second pump via the reserve flow control valve and the actuator, namely, combined operation consisting of turning of the first boom and arm and driving of the attachment.

Likewise, stopping of the operation of the primary flow control valve for the arm and the operation of the additional flow control valve for the arm in the state of the above-mentioned combined operation of the first and second booms, the arm and the attachment makes it possible to achieve combined operation consisting of turning of the first boom via the primary flow control valve for the first boom, the additional flow control valve for the first boom and the first boom cylinder, turning of the second boom via the flow control valve for the second boom and the second boom cylinder and driving of the attachment via the reserve flow control valve and the actuator, namely, combined operation consisting of turning of the first and second booms and driving of the attachment.

Similarly, stopping of the operation of the flow control valve for the second boom, the operation of the primary flow control valve for the arm and the operation of the additional flow control valve for the arm in the state of the above-mentioned combined driving of the first and second booms, the arm and the attachment makes it possible to achieve combined operation consisting of driving of the first boom and the attachment.

In a similar manner, stopping of the operation of the primary flow control valve for the first boom and the additional flow control valve for the first boom and the operation of the primary flow control valve for the arm and the additional flow control valve for the arm in the state of the above-mentioned combined driving of the first and second booms, the arm and the attachment makes it possible to achieve combined operation consisting of driving of the second boom and the attachment.

Likewise, stopping of the operation of the primary flow control valve for the first boom, the operation of the additional flow control valve for the first boom and the operation of the flow control valve for the second boom in the state of the above-mentioned combined driving of the first and second booms, the arm and the attachment makes it possible to achieve combined operation consisting of driving of the arm and the attachment.

As is understood from the foregoing, it is possible to achieve combined operation of the attachment and any one or more of the first and second booms and the arm.

To achieve the above-described object, the guide means (guide device) comprises a first line through which the primary flow control valve for the first boom and the flow control valve for the second boom are connected to the first pump in parallel with each other.

According to the invention of claim 3 constructed as described above, when the flow control valve for the second boom is changed over, the pressure fluid is guided from the first pump to the flow control valve for the second boom via the first line and is then fed to the second boom cylinder, so that the second boom can be turned as described above.

Even when the primary flow control valve for the first boom located upstream of the flow control valve for the second boom has been changed over full stroke, it is surely possible to feed the pressure fluid to the second boom cylinder via the flow control valve for the second boom and hence to turn the second boom.

To achieve the above-described object, the flow control valve for the second boom and the primary flow control valve for the arm are flow control valves of a hydraulic pilot-operated type; and the guide means (guide device) comprises a shuttle valve for outputting a pilot pressure, which is normally used to change over the flow control valve for the second boom, to a control compartment of the primary flow control valve for the arm so that the primary flow control valve for the arm is changed over.

According to the invention constructed as described above, when the flow control valve for the second boom is changed over, a pilot pressure for changing the flow control valve for the second boom is outputted from the shuttle valve and is then fed to the control compartment of the primary flow control valve for the arm, whereby the primary flow control valve for the arm is changed over into a predetermined position. If this predetermined position is set at a communicating position in advance, changing-over operation of the flow control valve for the second boom results in guidance of the pressure fluid, which flows out through the primary flow control valve for the first boom, to the flow control valve for the second boom via the communicating position of the primary flow control valve for the arm. The pressure fluid is then supplied to the second boom cylinder, so that the second boom can be turned as mentioned above.

Further, to achieve the above-described object, the system further comprises a directional control valve, which is changed over in response to the pilot pressure outputted from the shuttle valve so that feeding of pressure fluids, which are delivered from the first pump and the second pump, to the arm cylinder can be selectively stopped.

According to the invention constructed as described above, when the flow control valve for the second boom is changed over, a pilot pressure for changing the flow control valve for the second boom is outputted from the shuttle valve and is then fed to the control compartment of the primary flow control valve for the arm, as described above. The primary flow control valve for the arm is therefore changed over into the above-described communicating position. At this time, the directional control valve is changed over by the above-mentioned pilot pressure outputted from the shuttle valve and, by this directional control valve, feeding of a pilot pressure to change over the primary flow control valve for the arm and the additional flow control valve for the arm into positions, for example, for extending the arm cylinder is cut off. As a consequence, feeding of the fluid, which is delivered from the first pump, to the arm cylinder via the primary flow control valve for the arm and feeding of the fluid, which is delivered from the second pump, to the arm cylinder via the additional flow control valve are stopped. When the second boom is driven, the arm cylinder can therefore be prevented from extension to maintain the arm in a stopped state.

To achieve the above-described object, the invention, the system further comprises a second line which communicates a line, which is in communication with the first pump, with an upstream side of the additional flow control valve for the arm so that pressure fluid delivered from the first pump can be fed to the additional flow control valve for the arm.

According to the invention constructed as described above, the pressure fluid can be fed with priority from the first pump to the arm cylinder via, the second line when the arm and the second boom are operated in combination.

To achieve the above-described object, the second line is provided with a fixed restrictor.

According to the invention constructed as described above, upon combined operation of the arm and the second boom, the pressure fluid can be fed from the first pump to the arm cylinder via the second line, and the amount of the pressure fluid to be fed from the first pump to the arm cylinder can be limited by the fixed restrictor.

To achieve the above-described object, the invention, the second line is provided with a variable restrictor.

According to the invention of claim 8 constructed as described above, upon combined operation of the arm and the second boom, the pressure fluid can be fed from the first pump to the arm cylinder via the second line, and the amount of the pressure fluid to be fed from the first pump to the arm cylinder can be suitably adjusted as needed.

DETAILED DESCRIPTION OF THE INVENTION AND PREFERRED EMBODIMENTS

The preferred embodiments of the hydraulic drive system according to the present invention for construction machines will hereinafter be described with reference to the accompanying drawings.

Figure 1:
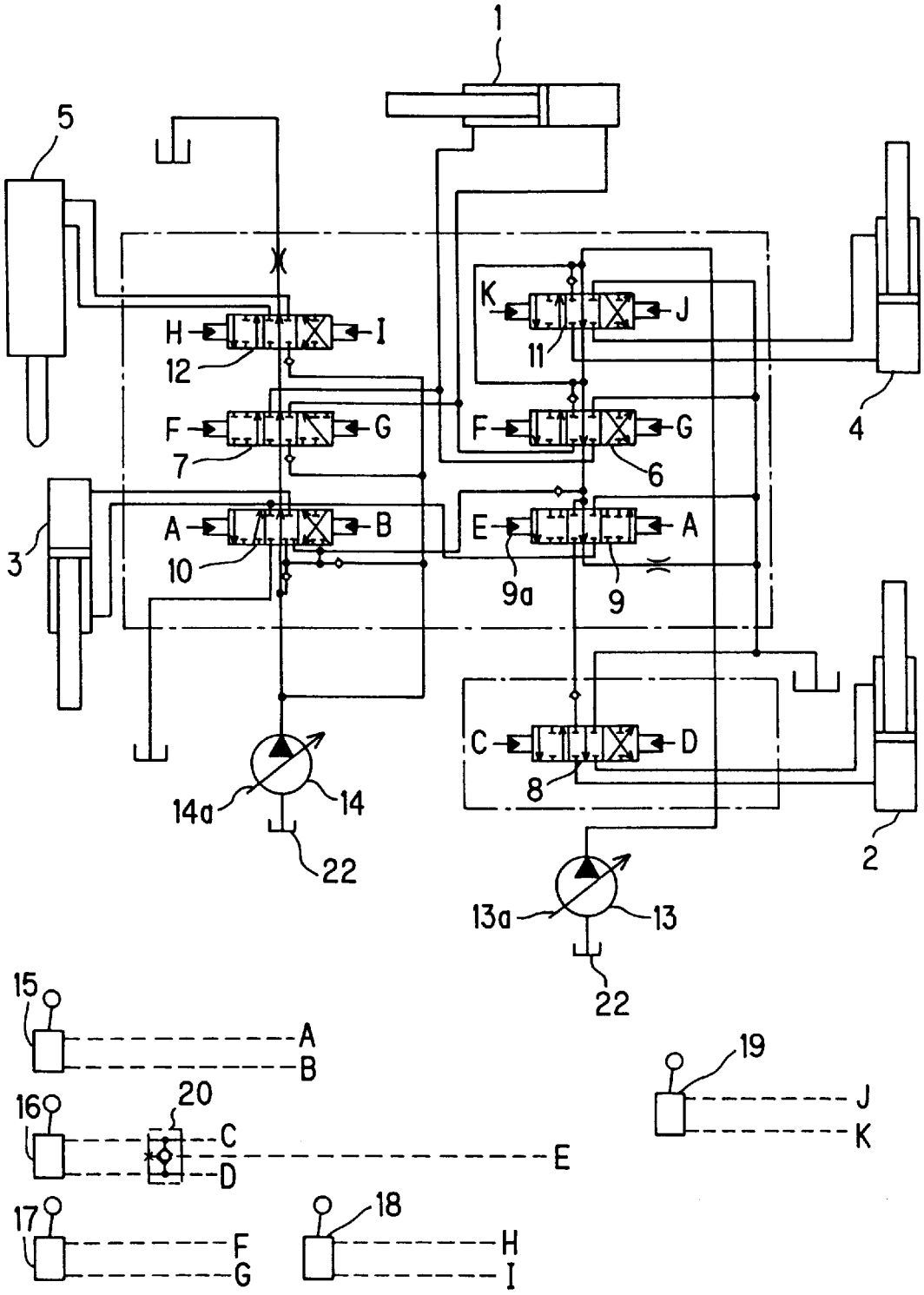
FIG. 1 is a hydraulic circuit diagram showing a first embodiment of the hydraulic drive system according to the present invention for a construction machine.

The hydraulic circuit diagram of FIG. 1 illustrates the first embodiment, second to sixth embodiments are depicted in the below-described FIGS. 2 to 6 therefore applied all embodiments are to hydraulic excavators by way of example.

Figure 7:
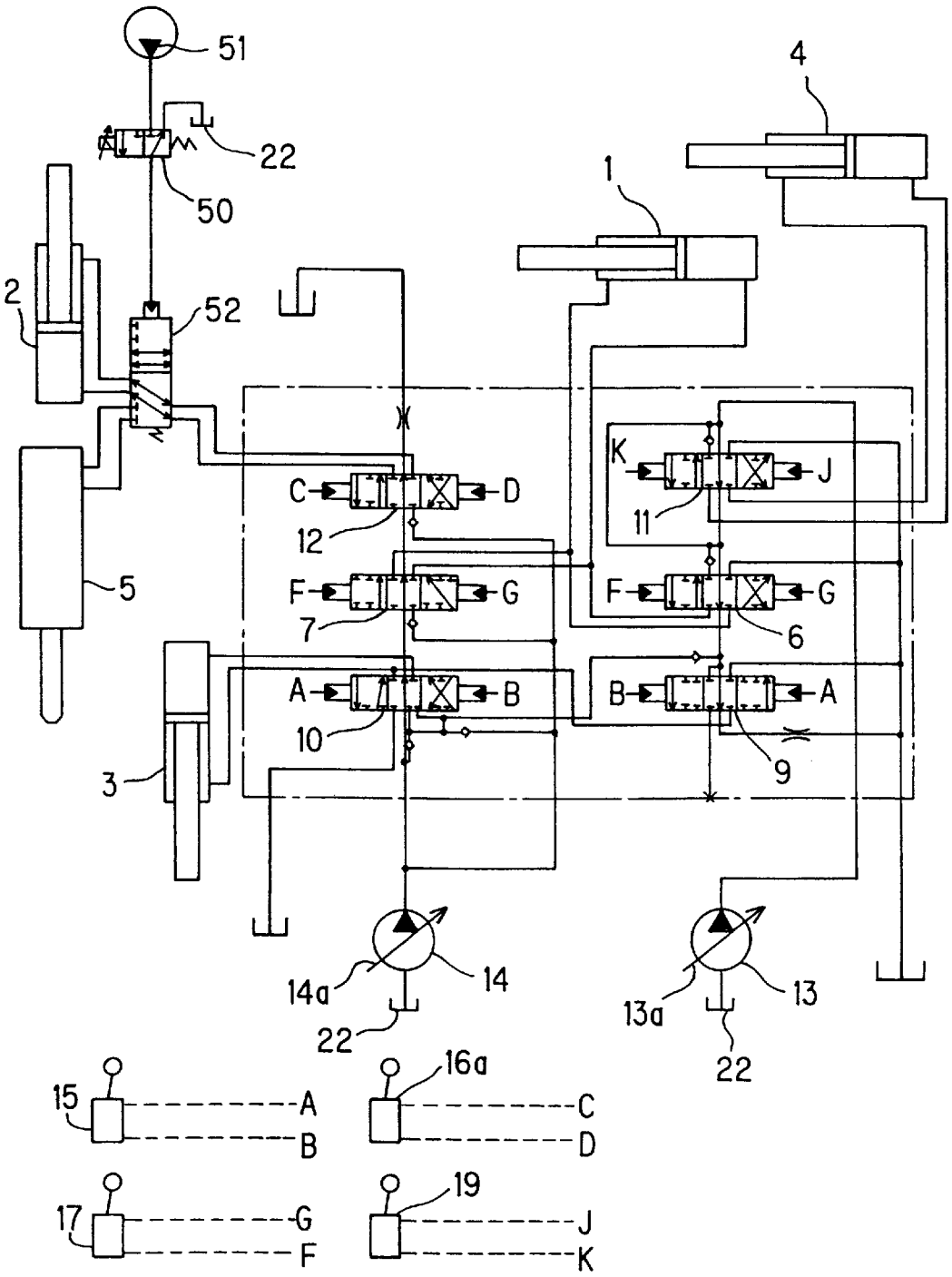
FIG. 7 PRIOR ART
FIG. 7 is the hydraulic circuit diagram illustrating the conventional hydraulic drive system for the construction machine.

In FIG. 1 showing the first embodiment, devices and members similar to their corresponding ones in the above-described FIG. 7 are identified by like reference numerals. Namely, the first embodiment shown in FIG. 1 is also provided with elongated members, for example, three elongated members although they are not shown there. The first elongated member is a first boom connected to a pivot cab turnably in a vertical plane, the second elongated member is a second boom connected to the first boom turnably in the vertical plane, and the third elongated member is an arm connected to the second boom turnably in the vertical plane. To conduct usual work such as digging, a bucket is mounted on a free end of the arm. Upon conducting work such as breaking, demolition or the like of rocks or a building, an attachment such as a vibrator or gripper is mounted on the free end of the arm in place of the bucket. Further, the hydraulic excavator is provided with a first pump 13 having a displacement-varying mechanism 13*a*, a second pump 14 having a displacement-varying mechanism 14*a*, and a reservoir 22 with fluid stored therein for suction by these pumps 13,14. The hydraulic excavator is also provided with a first hydraulic cylinder for turning the first elongated member, namely, a first boom cylinder 1; a second hydraulic cylinder for turning the second elongated member, namely, a second boom cylinder 6; a third hydraulic cylinder for turning the third elongated member, namely, an arm cylinder 3; a bucket cylinder 4 for turning an unillustrated bucket; and an actuator 5 for turning the above-mentioned attachment (not shown).

A group of flow control valves connected to the first pump 13 includes, for example, a flow control valve 11 for the bucket, said flow control valve 11 having a center bypass passage and being capable of controlling a flow of pressure fluid delivered from the first pump 13 to feed it to the bucket cylinder 4; a, primary flow control valve for the first elongated member, namely, a primary flow control valve 6 for the first boom, said flow control valve 6 being connected to the first pump 13 in parallel with the flow control valve 11 for the bucket, having a center bypass passage and being capable of controlling a flow of pressure fluid delivered from the first pump 13 to feed it to the first boom cylinder 1; and a primary flow control valve for the third elongated member, namely, a primary flow control valve 9 for the arm, said flow control valve 9 having a center bypass passage, being connected in tandem to a downstream side of the primary flow control valve 6 for the first boom and being capable of controlling a flow of pressure fluid delivered from the first pump 13 to feed it to the arm cylinder 3.

A group of flow control valves connected to the second pump 14 includes, for example, an additional flow control valve for the third elongated member, namely, an additional flow control valve 10 for the arm, which can control a flow of pressure fluid delivered from the second pump 14 to feed it to the arm cylinder 3; an additional flow control valve for the first elongated member, namely, an additional flow control valve 7 for the first boom, which can control a flow of pressure fluid delivered from the second pump 14 to feed it to the first boom cylinder 1; and a reserve flow control valve 12 which can control a flow of pressure fluid delivered from the second pump 14 to feed it to the above-mentioned attachment-driving actuator 5. The additional flow control valve 10 for the arm, the additional flow control valve 7 for the first boom and the reserve flow control valve 12 are connected to the second pump 14 in parallel with each other.

The primary flow control valve 9 for the arm and the additional flow control valve 10 for the arm are changed over by an arm operating device, for example, by a pilot valve 15 for the arm, which generates a pilot pressure. The reserve flow control valve 12 is changed over by an attachment operating device, for example, by a pilot valve 18 for the attachment, which generates a pilot pressure. The primary flow control valve 6 for the first boom and the additional flow control valve 7 for the first boom are changed over by a first boom operating device, for example, by a pilot valve 17 for the first boom, which generates a pilot pressure. The flow control valve 11 for the bucket is changed over by a bucket operating device, for example, by a pilot valve 19 for the bucket, which generates a pilot pressure. The above-described construction is substantially the same as the above-described conventional art illustrated in FIG. 7.

In the first embodiment, the flow control valve for the second elongated member, therefore is adapted to control driving of the second boom cylinder 2, namely, a flow control valve 8 for the second boom is arranged downstream of the primary flow control valve 9 for the arm. This flow control valve 8 for the second boom is changed over by a second boom operating device, for example, by a pilot valve 16 for the second boom, which generates a pilot pressure.

The first embodiment is provided with a guide means for guiding the pressure fluid from the first pump 13 to the flow control valve 8 for the second boom upon switching over the flow control valve 8 for the second boom. This guide means includes, for example, a shuttle valve 20 for outputting a pilot pressure, which is normally used to change over the flow control valve 8 for the second boom, and feeding it to one of control compartments, i.e., a control compartment 9*a* of the primary flow control valve 9 for the arm to change over the primary flow control valve 9 for the arm into a left position in FIG. 1 and also a construction for setting the primary flow control valve 9 for the arm in the left position in FIG. 1. This left-position-setting construction is such a construction as setting communication between a downstream side of the primary flow control valve 6 for the first boom and an upstream side of the flow control valve 8 for the second boom.

A description will hereinafter be made about operation of the first embodiment constructed as described above. Now assume that, for conducting work such as breaking or division of rocks or the like, an attachment such as a vibrator or gripper is mounted on a free end of, the arm in place of the bucket employed in usual work such as digging.

(1) Combined operation consisting of turning of the three elongated members, i.e., the first and second booms and the arm and driving of the attachment:

For example, with the primary flow control valve 6 for the first boom and the additional flow control valve 7 for the first boom maintained in their half-operated positions as a result of operation of the pilot valve 17 for the first boom, the pilot valve 16 for the second boom is operated to change over the flow control valve 8 for the second boom, the pilot valve 15 for the arm is operated to change over the primary flow control valve 9 for the arm and the additional flow control valve 10 for the arm, and the pilot valve 18 for the attachment is also operated to change over the reserve flow control valve 12. Then, the pressure fluid is guided from the first pump 13 to the primary flow control valve 6 for the first boom. Here, a pilot pressure, which has been outputted from the pilot valve 16 for the second boom as a result of the change-over of the flow control valve 8 for the second boom, is outputted from the shuttle valve 20 and is fed to the control compartment 9*a* of the primary flow control valve 9 for the arm, whereby the primary flow control valve 9 for the arm is forcedly changed over into the left position in FIG. 1, namely, to the left position where the downstream side of the primary flow control valve 6 for the first boom and the upstream side of the flow control valve 8 for the second boom are brought into communication with each other. As a consequence, surplus fluid from the first pump as a result of the above-mentioned half-operation of the primary flow control valve 6 for the first boom is guided to the flow control valve 8 for the second boom via the primary flow control valve 9 for the arm. Accordingly, the pressure fluid is fed at a flow rate, which corresponds to the half stroke of the primary flow control valve 6 for the first boom, to the first boom cylinder 1 via the primary flow control valve 6 for the first boom, so that the first boom can be turned at a relatively slow speed. Further, the pressure fluid is also fed at a flow rate, which corresponds to a change-over stroke of the flow control valve 8 for the second boom, to the second boom cylinder via the flow control valve 8 for the second boom, so that the second boom can be turned. On the other hand, the pressure fluid from the second pump 14 is fed in parallel to the additional flow control valve 7 for the first boom, the additional flow control valve 10 for the arm and the reserve flow control valve 12. Therefore, pressure fluid is fed to the arm cylinder 3 via the additional flow control valve 10 for the arm, so that the arm can be turned. Further, pressure fluid is also fed to the actuator 5 via the reserve flow control valve 12, so that the attachment can be driven. Depending on the relative levels of load pressures applied upon driving the first and second boom, the arm and the attachment, surplus pressure fluid from the second pump 14 merges with the above-mentioned pressure fluid flowed out of the primary flow control valve 6 for the first boom via the additional flow control valve 7 for the first boom, is fed to the first boom cylinder 1, and is then used to turn the first boom. Further, a portion of surplus pressure fluid from the first pump 13 is fed from the upstream side of the primary flow control valve 9 for the arm to the additional flow control valve for the arm in such a way that the portion of the surplus pressure fluid merges with the pressure fluid from the second pump 14. The thus-combined pressure fluid is fed to the arm cylinder 3 and is then used to turn the arm. In the manner as described above, it is possible to achieve combined operation consisting of turning of all the first and second booms and the arm and driving of the attachment.

(2) Combined operation consisting of turning of the second boom and the arm and driving of the attachment:

If the operation of the primary flow control valve 6 for the first boom and the additional flow control valve 7 for the first boom is stopped in the state of the above-mentioned combined operation consisting of turning of the three elongated members, i.e., the first and second booms and the arm and driving of the attachment, the pressure fluid can be fed from the first pump 13 to the second boom cylinder 2 via the flow control valve 8 for the second boom to turn the second boom, the pressure fluid can be fed from the second pump 14 to the arm cylinder 3 via the additional flow control valve 10 for the arm to turn the arm, and the pressure fluid can also fed from the second pump 14 to the actuator 5 via the reserve flow control valve 12 to drive the attachment. Namely, it is possible to achieve combined operation consisting of turning of the second boom and the arm and driving of the attachment.

(3) Combined operation consisting of turning of the first boom and the arm and driving of the attachment:

If the operation of the flow control valve 8 for the second boom in the state of the above-mentioned combined operation consisting of turning of the three elongated members, i.e., the first and second booms and the arm and driving of the attachment, the pressure fluid is fed from the first pump 13 to the first boom cylinder 2 via the primary flow control valve 6 for the first boom to turn the first boom, and the pressure fluid is also fed from the second pump 14 to the arm cylinder 3 via the additional flow control valve 10 for the arm to turn the arm, and the pressure fluid is also fed from the second pump 14 to the actuator 5 via the reserve flow control valve 12 to drive the attachment. Namely, it is possible to achieve combined operation consisting of turning of the first boom and the arm and driving of the attachment.

(4) Combined operation consisting of turning of the first and second booms and driving of the attachment:

If, in the state of the above-mentioned combined operation consisting of turning of the three elongated members, i.e., the first and second booms and the arm and driving of the attachment, the operation of the primary flow control valve 9 for the arm and the additional flow control valve 10 for the arm is stopped and the primary flow control valve 6 for the first boom is maintained in the half-operated position, the pressure fluid can be fed from the first pump 13 to the first boom cylinder 1 via the primary flow control valve 6 for the first boom to turn the first boom, surplus pressure fluid of the first pump 13, said surplus pressure fluid having flowed out from the primary flow control valve 6 for the first boom, can be fed to the second boom cylinder 2 via the flow control valve 8 for the second boom to turn the second boom, and the pressure fluid can also be from the second pump 14 to the actuator 5 via the reserve flow control valve 12 to drive the attachment. Namely, it is possible to achieve combined operation consisting of turning of the first and second booms and driving of the attachment.

(5) Combined operation consisting of turning of the first boom and driving of the attachment:

If the operation of the flow control valve 8 for the second boom, the primary flow control valve 9 for the arm and the additional flow control valve 10 for the arm is stopped in the state of the above-mentioned combined operation consisting of turning of the three elongated members, i.e., the first and second booms and the arm and driving of the attachment, the pressure fluid is fed from the first pump 13 to the first boom cylinder 1 via the primary flow control valve 6 for the first boom and the pressure fluid is also fed from the second pump 14 to the actuator 5 primarily via the reserve flow control valve 12. It is therefore possible to achieve combined operation consisting of turning of the first boom and driving of the attachment.

(6) Combined operation consisting of turning of the second boom and driving of the attachment:

If the operation of the primary flow control valve 6 for the first boom, the additional flow control valve 7 for the first boom, the primary flow control valve 9 for the arm and the additional flow control valve 10 for the arm is stopped in the state of the above-mentioned combined operation consisting of turning of the three elongated members, i.e., the first and second booms and the arm and driving of the attachment, the pressure fluid is fed from the first pump 13 to the second boom cylinder 2 via the flow control valve 8 for the second boom and the pressure fluid is also fed from the second pump 14 to the actuator 5 primarily via the reserve flow control valve 12. It is therefore possible to achieve combined operation consisting of turning of the second boom and driving of the attachment.

(7) Combined operation consisting of turning of the arm and driving of the attachment:

If the operation of the primary flow control valve 6 for the first boom, the additional flow control valve 7 for the first boom and the flow control valve 8 for the second boom is stopped in the state of the above-mentioned combined operation consisting of turning of the three elongated members, i.e., the first and second booms and the arm and driving of the attachment, the pressure fluid is fed from the first pump 13 to the arm cylinder 3 via the primary flow control valve 9 for the arm and the pressure fluid is also fed from the second pump 14, for example, to the actuator 5 primarily via the reserve flow control valve 12. It is therefore possible to achieve combined operation consisting of turning of the arm and driving of the attachment.

As is evident from the foregoing, the first embodiment can achieve combined operation of the attachment and any one or more of the first and second booms and the arm, thereby making it possible to improve the efficiency of work by the attachment. Further, combined operation including the attachment and the second boom can be achieved without needing any directional control valve which selects either driving of the attachment or turning of the second boom. The operator can therefore be protected from the above-described irksome and tired feeling which is associated with operation of such a directional control valve, thereby assuring good accuracy for work.

Figure 2:
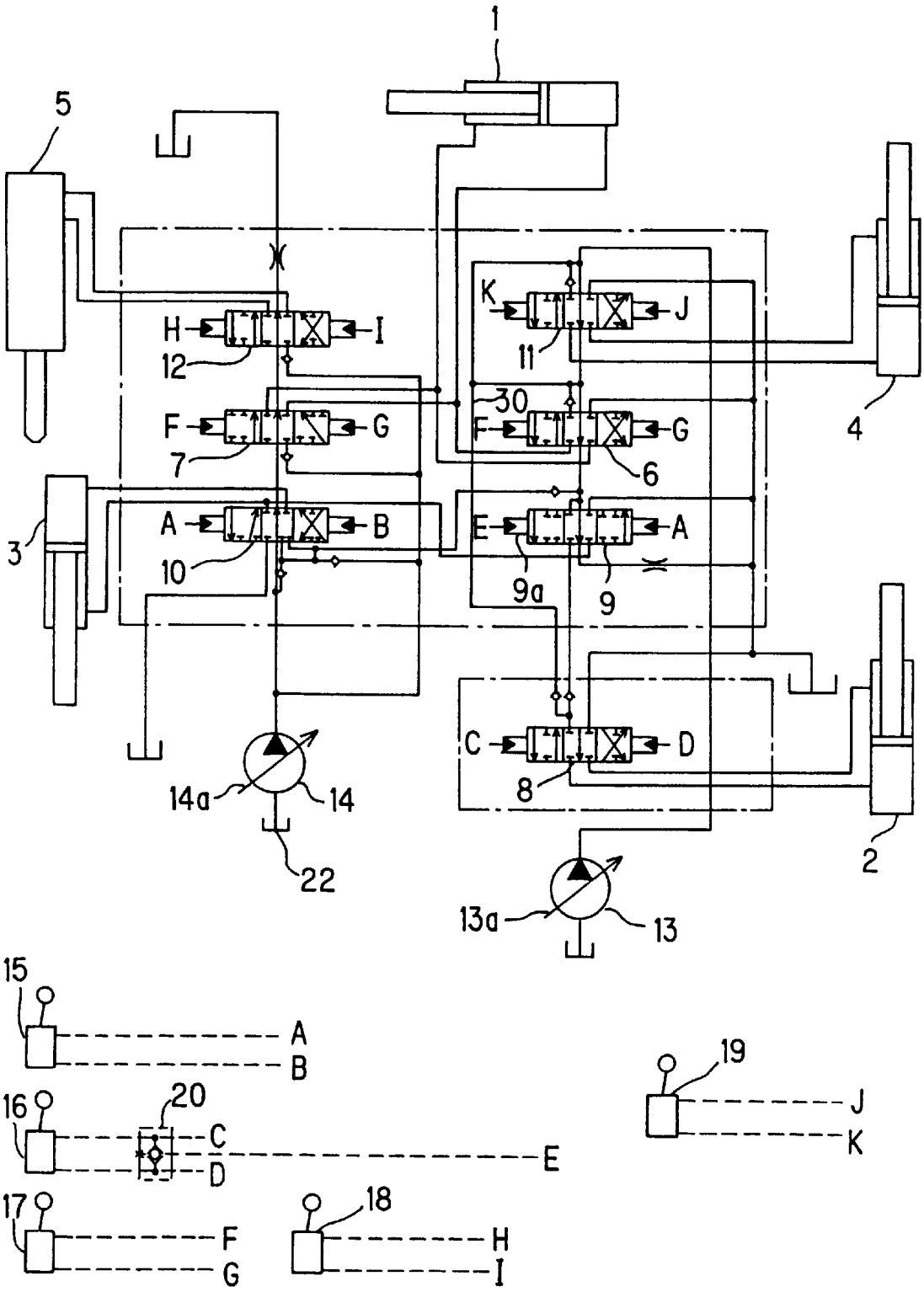
FIG. 2 is a hydraulic circuit diagram showing a second embodiment of the hydraulic drive system according to the present invention for a construction machine.

The hydraulic circuit diagram of FIG. 2 shows the second embodiment. This second embodiment has the construction that the guide means, which serves to guide the pressure fluid from the first pump 13 to the flow control valve 8 for the second boom upon switching the flow control valve 8 for the second boom, includes a first line 30 which connects the primary flow control valve 6 for the first boom and the flow control valve 8 for the second boom to the first pump 13 in parallel with each other. The remaining construction is similar to the corresponding construction of the above-described first embodiment shown in FIG. 1.

According to the second embodiment constructed as described above, when the flow control valve 8 for the second boom is changed over by operating the pilot valve 16 for the second boom, the pressure fluid is guided from the first pump 13 to the flow control valve 8 for the second boom via the first line 30 no matter whether the primary flow control valve 6 for the first boom, said primary flow control valve 6 being located upstream of the flow control valve 8 for the second boom, has been changed over. The pressure fluid is then fed to the second boom cylinder 2, so that the second boom can be turned. Even when the primary flow control valve 6 for the first boom has been switched over full stroke, it is therefore surely possible to feed the pressure fluid to the second boom cylinder 2 via the flow control valve 8 for the second boom and then to turn the second boom. Other advantageous effects are similar to those described above in connection with the first embodiment.

Figure 3:
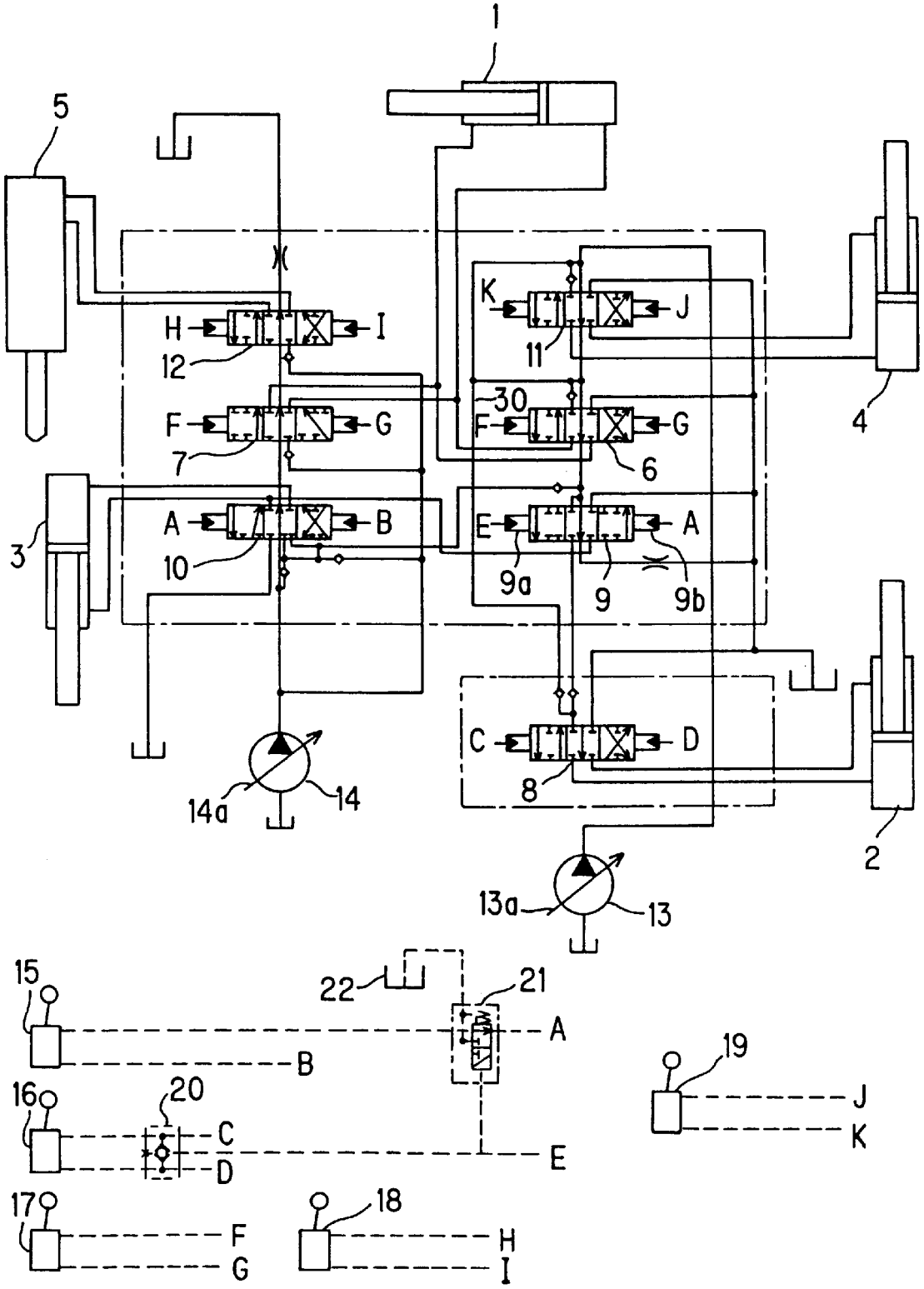
FIG. 3 is a hydraulic circuit diagram showing a third embodiment of the hydraulic drive system according to the present invention for a construction machine.

The hydraulic circuit diagram of FIG. 3 depicts the third embodiment. This third embodiment has a construction with a directional control valve 21 arranged therein. The directional control valve 21 is changed over responsive to a pilot pressure outputted from the shuttle valve 20, thereby making it possible to selectively stop the feeding of pressure fluids, which are delivered from the first pump 13 and the second pump 14, to the arm cylinder 3. The remaining construction is similar to the corresponding construction of the above-described second embodiment shown in FIG. 2. According to the third embodiment constructed as described above, operation of the pilot valve 16 for the second boom causes the shuttle valve 20 to output a pilot pressure which is normally used to change over the flow control valve 8 for the second boom. This pilot pressure is then fed to one of the control compartments, i.e., the control compartment 9*a* of the primary flow control valve 9 for the arm so that the primary flow control valve 9 for the arm is changed over into the left position in FIG. 3. At this time, the directional control valve 21 is changed over by the above-mentioned pilot pressure outputted from the shuttle valve 20, and the other control compartment 9*b* of the primary flow control valve 9 for the arm is communicated to the reservoir 22 via the directional control valve 21. Accordingly, by the above-mentioned pilot pressure applied to the one control compartment 9*a*, the primary flow control valve 9 for the arm is surely changed over into the left position in FIG. 3. On the other hand, when the additional flow control valve 10 for the arm, said additional flow control valve 10 being arranged on the side of the second pump 14, has been changed over in the left position in FIG. 3, namely, in the position for extending the arm cylinder 3, this additional flow control valve 10 for the arm is forced to return into a center position. As a result, the feeding of the pressure fluid, which is delivered from the first pump 13, to the arm cylinder 3 via the primary flow control valve 9 for the arm, namely, from the upstream side of the primary flow control valve 9 for the arm and the feeding of the pressure fluid, which is delivered from the second pump 14, to the arm cylinder 3 via the additional flow control valve 10 for the arm are stopped. In other words, the arm is maintained in a stopped state, and the turning of the second boom through the driving of the second boom cylinder by the pressure fed from the first pump 13 via the flow control valve 8 for the second boom is only performed. Incidentally, concerning combined operation consisting of contraction of the arm cylinder 3 and turning of the second boom, changing over of the directional control valve 21 is independent from changing-over of the additional flow control valve 10 for the arm. In this case, it is therefore possible to perform combined operation consisting of turning of the arm by the contraction of the arm cylinder 3 and turning of the second boom and also to assure the independence of the respective operations. Other advantageous effects are similar to the corresponding ones available from the second embodiment described above.

Figure 4:
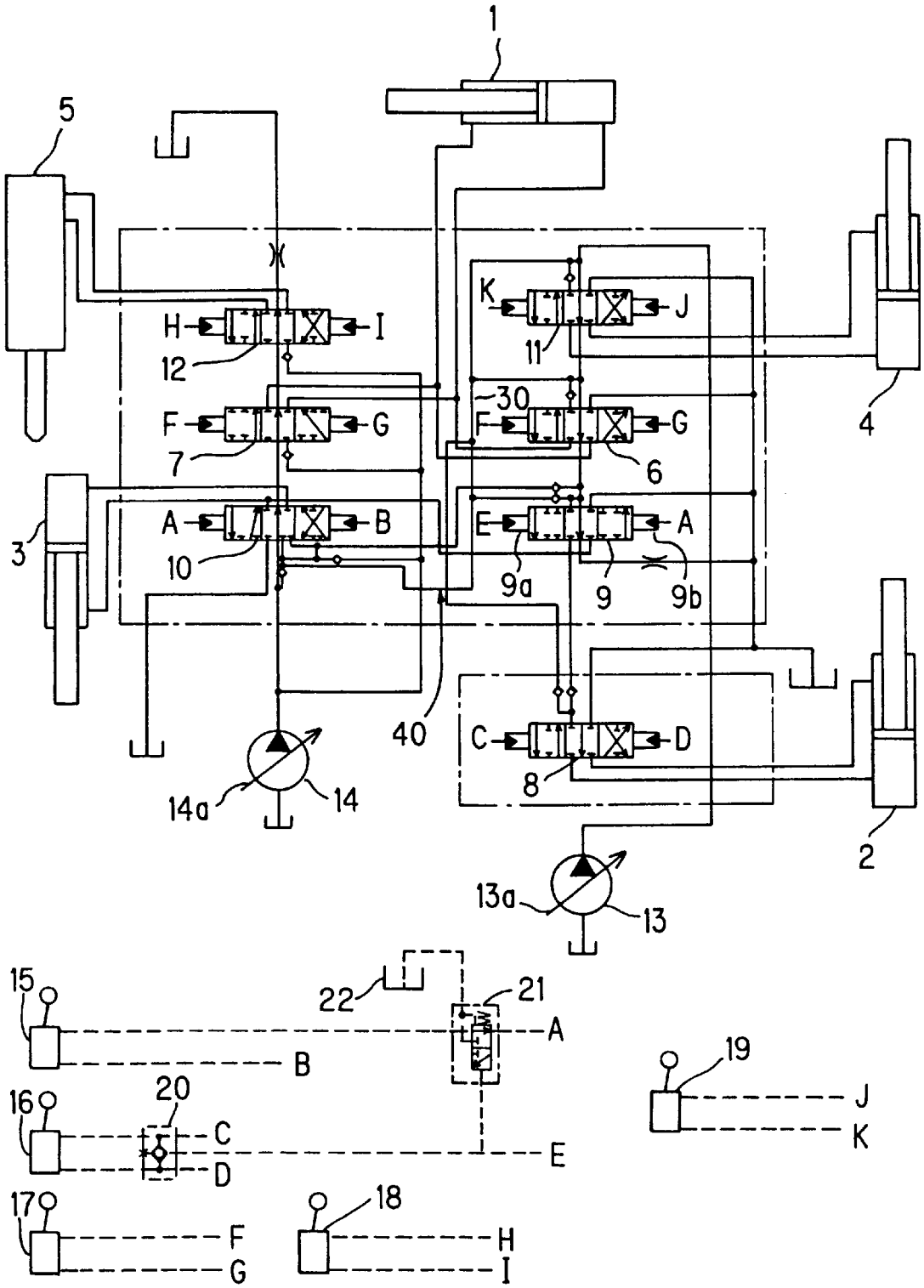
FIG. 4 is a hydraulic circuit diagram showing a fourth embodiment of the hydraulic drive system according to the present invention for a construction machine.

The hydraulic circuit diagram of FIG. 4 illustrates the fourth embodiment. This fourth embodiment has a construction with a second line 40 arranged therein. The second line 40 communicates the line, which is in communication with the first pump 13, to the upstream side of the additional flow control valve 10 for the arm, which is arranged on the side of the second pump 14, and therefore can feed the pressure fluid from the first pump 13 to the additional flow control valve 10 for the arm. The remaining construction is similar to the corresponding construction of the above-described third embodiment shown in FIG. 3.

According to the fourth embodiment constructed as described above, during combined operation of the arm and the second boom by the control of the pilot valve 15 for the arm and the pilot valve 16 for the second boom, namely, during combined operation consisting of turning of the arm by the contraction of the arm cylinder 3 and turning of the second boom, the pressure fluid delivered from the first pump 13 can be fed to the additional flow control valve 10 for the arm via the second line 40 so that the pressure fluid can merge with the pressure fluid delivered from the second pump 14. This makes it possible to feed the pressure fluid from the first pump 13 to the arm cylinder 3 with priority to the second boom cylinder 2. It is therefore possible to perform work by giving priority to the turning of the arm during the combined operation consisting of the turning of the arm by the contraction of the arm cylinder 3 and the turning of the second boom. Other advantageous effects are similar to the corresponding ones available from the above-described third embodiment illustrated in FIG. 3.

Figure 5:
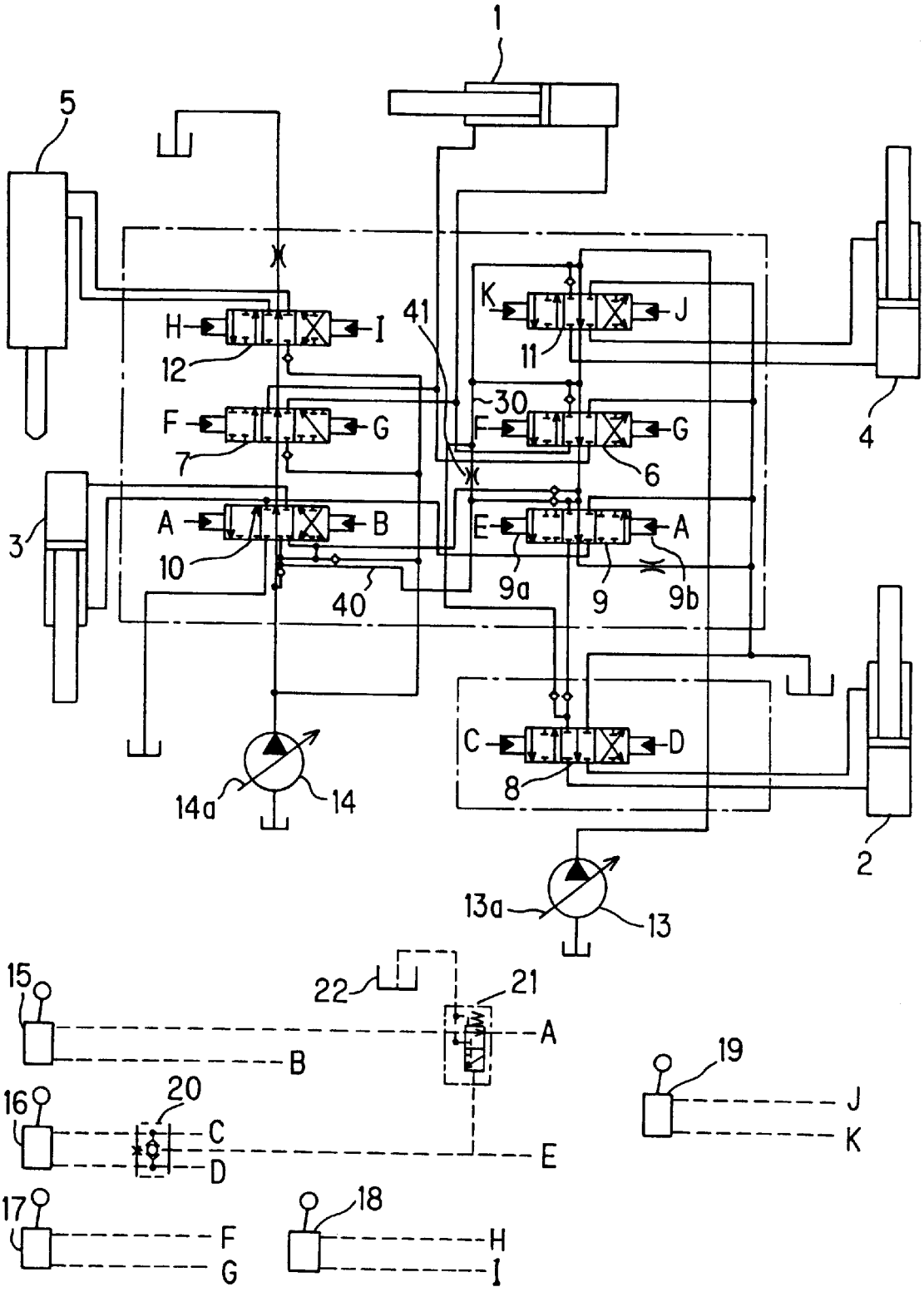
FIG. 5 is a hydraulic circuit diagram showing a fifth embodiment of the hydraulic drive system according to the present invention for a construction machine.

The hydraulic circuit diagram of FIG. 5 illustrates the fifth embodiment. This fifth embodiment has a construction with a fixed restrictor 41 arranged in the second line 40. The remaining construction is similar to the corresponding construction of the above-described third embodiment shown in FIG. 4.

According to the fifth embodiment constructed as described above, during combined operation consisting of turning of the arm by the contraction of the arm cylinder 3 and turning of the second boom, the pressure fluid can be fed from the first pump 13 to the arm cylinder 3 via the second line 40 as in the above-described fourth embodiment, and moreover, the feeding of the pressure fluid from the first pump 13 to the arm cylinder 3 can be regulated in a wholesale manner by the fixed restrictor 41. Accordingly, the amount of the pressure fluid to be fed from the first pump 13 to the second boom cylinder 2 via the fist line 30 and the flow control valve 8 for the second boom and that of the pressure fluid to be fed from the first pump 13 to the arm cylinder 3 via the second line 40 and the additional flow control valve 10 for the arm can be set at a suitable ratio depending on the work to be performed by driving the attachment through the actuator 5. This makes it possible to improve the efficiency of the work which is performed by driving the attachment. Other advantageous effects are similar to the corresponding ones available from the above-described fourth embodiment illustrated in FIG. 4.

Figure 6:
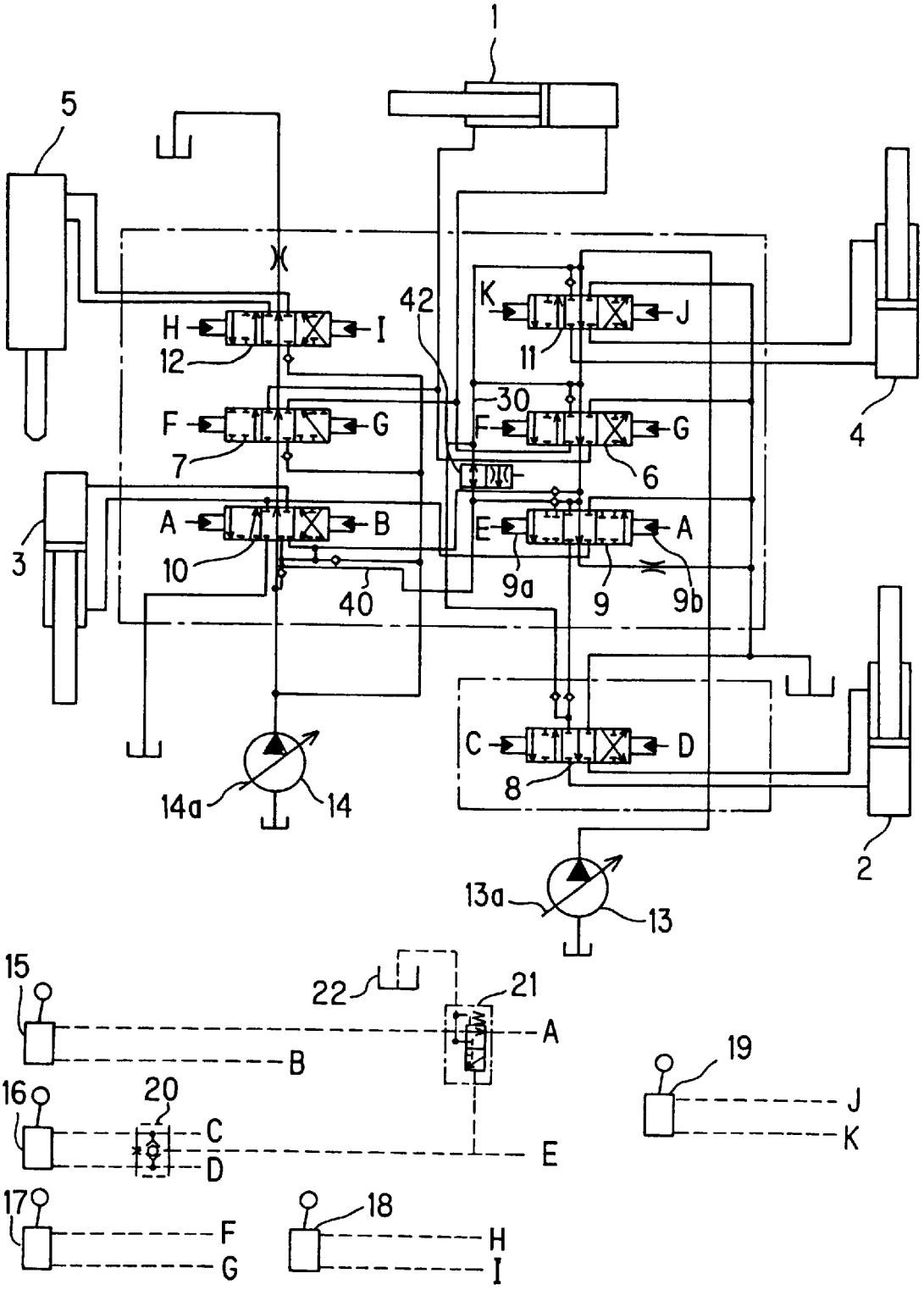
FIG. 6 is a hydraulic circuit diagram showing a sixth embodiment of the hydraulic drive system according to the present invention for a construction machine.

The hydraulic circuit diagram of FIG. 6 illustrates the sixth embodiment. This fifth embodiment has a construction with a variable restrictor 42 arranged in the second line 40. When the pilot valve 15 for the arm is operated to contract the arm cylinder 3, this variable restrictor 42 increases the degree of restriction, in other words, decreases the area of opening as the stroke of the pilot valve 15 for the arm becomes greater, so that the variable restrictor 42 functions to restrict the flow of the hydraulic pressure from the first pump 13 to the second line 40. The remaining construction is similar to the corresponding construction of the above-described third embodiment shown in FIG. 4.

According to the sixth embodiment constructed as described above, when the pilot valve 15 for the arm is operated to change over the additional flow control valve 10 for the arm into a right position in FIG. 6 during combined operation consisting of turning of the arm by the contraction of the arm cylinder 3 and the turning of the second boom, the variable restrictor 42 is changed over toward a right position in FIG. 6 corresponding to the stroke of the pilot valve 15 for the arm, whereby the area of opening of the variable restrictor 42 becomes smaller.. At this time, the pressure fluid from the first pump 13 is more difficult to flow through the variable restrictor 42, resulting in the tendency that the pressure fluid from the first pump 13 is guided in a greater proportion toward the cylinder 2 for the second boom via the first line 30 and the flow control valve 8 for the second boom. In other words, an adjustment to the stroke of the pilot valve 15 for the arm makes it possible to suitably change the turning speed of the arm and that of the second boom for the maintenance of adequate matching therebetween. In this respect, the efficiency of the work can be improved.

In each of the above-described embodiment, the hydraulic drive system for the hydraulic excavator was described as a hydraulic drive system for a construction machine. The present invention is however applicable to any hydraulic drive system insofar as it is of such a construction as performing combined operation of any one or more of elongated members and an attachment.

As has been described above, concerning a construction machine equipped with at least three elongated members and an attachment, the present invention can achieve combined operation of any one or more of the at least three elongated members and the attachment, thereby making it possible to improve the efficiency of work by the attachment over the conventional art.

Further, without needing such a directional control valve as that arranged in the conventional art for the selection of either driving of the attachment or turning of the second elongated member, the present invention can achieve combined operation involving the attachment and the second elongated member. The operator can therefore be protected from the above-described irksome and tired feeling which is associated with operation of such a directional control valve, thereby assuring good accuracy for work.

What is claimed is:

1. A hydraulic drive system for a construction machine, said hydraulic drive system being provided with:

a first pump and second pump of a variable displacement type, a first hydraulic cylinder for turning a first elongated member, a second hydraulic cylinder for turning a second elongated member connected to said first elongated member, a third hydraulic cylinder for turning a third elongated member connected to said second elongated member, and an actuator for driving an attachment connectable to said third elongated member, a primary first flow control valve having a center bypass passage and capable of controlling a flow of pressure fluid delivered from said first pump to feed said pressure fluid delivered from said first pump to feed said pressure fluid to said first hydraulic cylinder, a second flow control valve capable of controlling a flow of pressure fluid delivered from said first pump to feed said pressure fluid to said second hydraulic cylinder, and a primary third flow control valve having a center bypass passage, connected downstream of said primary first flow control valve and capable of controlling a flow of pressure fluid delivered from said first pump to supply said pressure fluid to said third hydraulic cylinder, and an additional third flow control valve capable of controlling a flow of pressure fluid delivered from said second pump to feed said pressure fluid to said third hydraulic cylinder, an additional first flow control valve capable of controlling a flow of pressure fluid delivered from said second pump to feed said pressure fluid to said first hydraulic cylinder, and a reserve flow control valve capable of controlling a flow of pressure fluid delivered from said second pump to feed said pressure fluid to said actuator, said additional third flow control valve, said additional first flow control valve and said reserve flow control valve being connected to said second pump in parallel with each other, wherein:

said second flow control valve is arranged downstream of said primary third flow control valve; and a guide device is arranged to guide pressure fluid, which is delivered from said first pump, to said second flow control valve upon changing over said second flow control valve, wherein said construction machine is a hydraulic excavator;

said first elongated member is a first boom, said second elongated member is a second boon, said third elongated member is an arm, said hydraulic cylinder for said first elongated member is a first boom cylinder, said hydraulic cylinder for said second elongated member is a second boom cylinder, and said hydraulic cylinder for said third elongated member is an arm cylinder;

said primary first flow control valve is a primary flow control valve for said first boom;

said additional first flow control valve is an additional flow control valve for said first boom;

said second flow control valve is a flow control valve for said second boom;

said primary third flow control valve is a primary flow control valve for said arm; and said additional third flow control valve is an additional flow control valve for said arm, and wherein said guide device comprises a first line through which said primary flow control valve for said first boom and said flow control valve for said second boom are connected to said first pump in parallel with each other.

2. The hydraulic drive system according to claim 1, wherein:

said flow control valve for said second boom and said primary flow control valve for said arm are flow control valves of a hydraulic pilot-operated type; and said guide device comprises a shuttle valve for outputting a pilot pressure, which is normally used to change over said flow control valve for said second boom, to a control compartment of said primary flow control valve for said arm so that said primary flow control valve for said arm is changed over.

3. The hydraulic drive system according to claim 2, further comprising a directional control valve, which is changed over in response to said pilot pressure outputted from said shuttle valve so that feeding of pressure fluids, which are delivered from said first pump and said second pump, to said arm cylinder is selectively stopped.

4. The hydraulic drive system according to claim 3, further comprising a second line which communicates a line, which is in communication with said first pump, with an upstream side of said additional flow control valve for said arm so that pressure fluid delivered from said first pump can be fed to said additional flow control valve for said arm.

5. The hydraulic drive system according to claim 4, wherein said second line is provided with a fixed restrictor.

6. The hydraulic drive system according to claim 4, wherein said second line is provided with a variable restrictor.

* * * * *